United States Patent [19]

Rathe et al.

[11] Patent Number: 4,514,939

[45] Date of Patent: May 7, 1985

[54] EXTENSIBLE BOOM WITH MANUAL SECTION STORED IN BASE

[75] Inventors: Robert A. Rathe, Cedar Rapids; Thomas J. Volkmann, Hiawatha, both of Iowa

[73] Assignee: FMC Corporation, Chicago, Ill.

[21] Appl. No.: 648,619

[22] Filed: Sep. 10, 1984

Related U.S. Application Data

[63] Continuation of Ser. No. 293,728, Aug. 17, 1981, abandoned.

[51] Int. Cl.[3] ..... E04H 12/34

[52] U.S. Cl. ..... 52/118; 212/230

[58] Field of Search ..... 52/115–117, 52/121; 212/230, 231

[56] References Cited

U.S. PATENT DOCUMENTS

| | | | |
|---|---|---|---|
| 2,999,600 | 9/1961 | Gates | 212/55 |
| 3,368,696 | 2/1968 | Johnston et al. | 212/59 |
| 3,371,799 | 3/1968 | Brownell et al. | 212/35 |
| 3,386,594 | 6/1968 | Grove | 212/55 |
| 3,398,492 | 8/1968 | Nansel | 52/115 |
| 3,605,358 | 9/1971 | Bentey | 52/121 |
| 3,624,979 | 12/1971 | Przybylski | 52/115 |
| 3,770,138 | 11/1973 | Chalupsky et al. | 52/115 |
| 3,795,321 | 3/1974 | Johnston | 212/55 |
| 3,809,249 | 5/1974 | Grove | 212/55 |
| 3,842,985 | 10/1974 | Svede | 52/121 |
| 3,921,819 | 11/1975 | Spain | 52/115 |
| 4,036,372 | 7/1977 | Rao et al. | 212/144 |
| 4,132,040 | 1/1979 | Grove | 52/115 |
| 4,156,331 | 5/1979 | Lester et al. | 52/115 |
| 4,217,987 | 8/1980 | Gattu et al. | 112/144 |
| 4,327,533 | 5/1982 | Sterner | 52/115 |
| 4,352,434 | 10/1982 | Poock | 52/116 |

*Primary Examiner*—James L. Ridgill, Jr.

*Attorney, Agent, or Firm*—A. J. Moore; H. M. Stanley; R. B. Megley

[57] ABSTRACT

A multi-section telescopic boom is disclosed having a base section supported for pivotal movement, a manual section telescopically received in said base section, a mid section, and a tip section which sections are progressively lighter from the base section to the tip section when excluding the weight of head machinery connected to the tip section. The heavy manual section is stored in the base section when a load to be transferred between two locations can be reached with the mid and tip sections extended thereby substantially decreasing the turning moment about the pivot axis due to the weight of the boom sections resulting in an increased load carrying capacity of the boom. The boom is preferably supported by a pendant line operatively connected to the outer end of the tip and base sections and trained within the boom to aid a single hydraulic ram to extend and retract selected sections of the boom.

4 Claims, 7 Drawing Figures

EXTENSIBLE BOOM WITH MANUAL SECTION STORED IN BASE

This application is a continuation of application Ser. No. 293,728, filed 8-17-81, now abandoned.

CROSS REFERENCE TO RELATED APPLICATIONS

The present application is related to several United States applications all of which are assigned to the assignee of the present invention, and were filed on the indicated date or on even date herewith. The applications are as follows:

Poock Application Ser. No. 145,529 which was filed on May 1, 1980 which issued on Oct. 5, 1982 as U.S. Pat. No. 4,352,434 entitled "PENDANT SUPPORTED HYDRAULIC EXTENSIBLE BOOM".

Cozad Application Ser. No. 293,727 filed on Aug. 17, 1981 and entitled LOW DROOP MULTI-PART PENDANT SUPPORTED BOOM.

Rathe Application Serial No. 293,729 filed on Aug. 17, 1981 and entitled COUPLING AND LATCHING MECHANISM FOR EXTENSIBLE BOOM.

BACKGROUND OF THE INVENTION

1. Field of the Invention

The present invention relates to multi-section telescopic booms, and more particularly relates to a four section pendant supported boom having a manual section stored in its base with the extensible boom sections being extended and retracted by a single hydraulic ram aided by extend and retract cables for actuating the tip section.

2. Description of the Prior Art

As used herein and as understood in the art, a manual section is a boom section that is normally retracted within its supporting boom section but may be coupled to the boom extend and retract power means and be extended when needed to increase the reach of the boom.

Multi-section, pendant supported telescopic booms for cranes or the like which are operated by single hydraulic rams or a plurality of rams are well known in the art. However, applicants are unaware of art which discloses a boom with a manual section that is stored in the base section of the boom.

SUMMARY OF THE INVENTION

In accordance with the preferred embodiment of the present invention a multi-section telescopic boom is arranged so that its second heaviest boom section is the manual section which is stored in the base and when in conjunction with the pendant support thereby increases the boom load capacity about 15 percent as compared to a conventional boom of the same size, shape, and overall weight but with the manual section being the tip section. This load advantage is accomplished when the manual is stored in the base section since the turning moment about the boom pivot axis is reduced. The manual is extended only when needed to reach a load.

In the preferred embodiment of the four section boom, a single hydraulic ram, aided by a tip section extend-retract cable, is provided to extend and retract the mid and tip sections proportionally relative to the manual section. When less than full extension of the boom is required, the manual is stored and pinned to the base section, and the piston rod is connected to the manual section for extending and retracting the outer two sections relative to the manual section. When full extension of the boom is required, the piston rod is initially connected to the base to extend the manual relative to the base. The manual is then locked in extended position, the piston rod is disconnected and retracted from the base, and is then reconnected to the manual section.

DESCRIPTION OF THE PREFERRED EMBODIMENT

Figure 1:
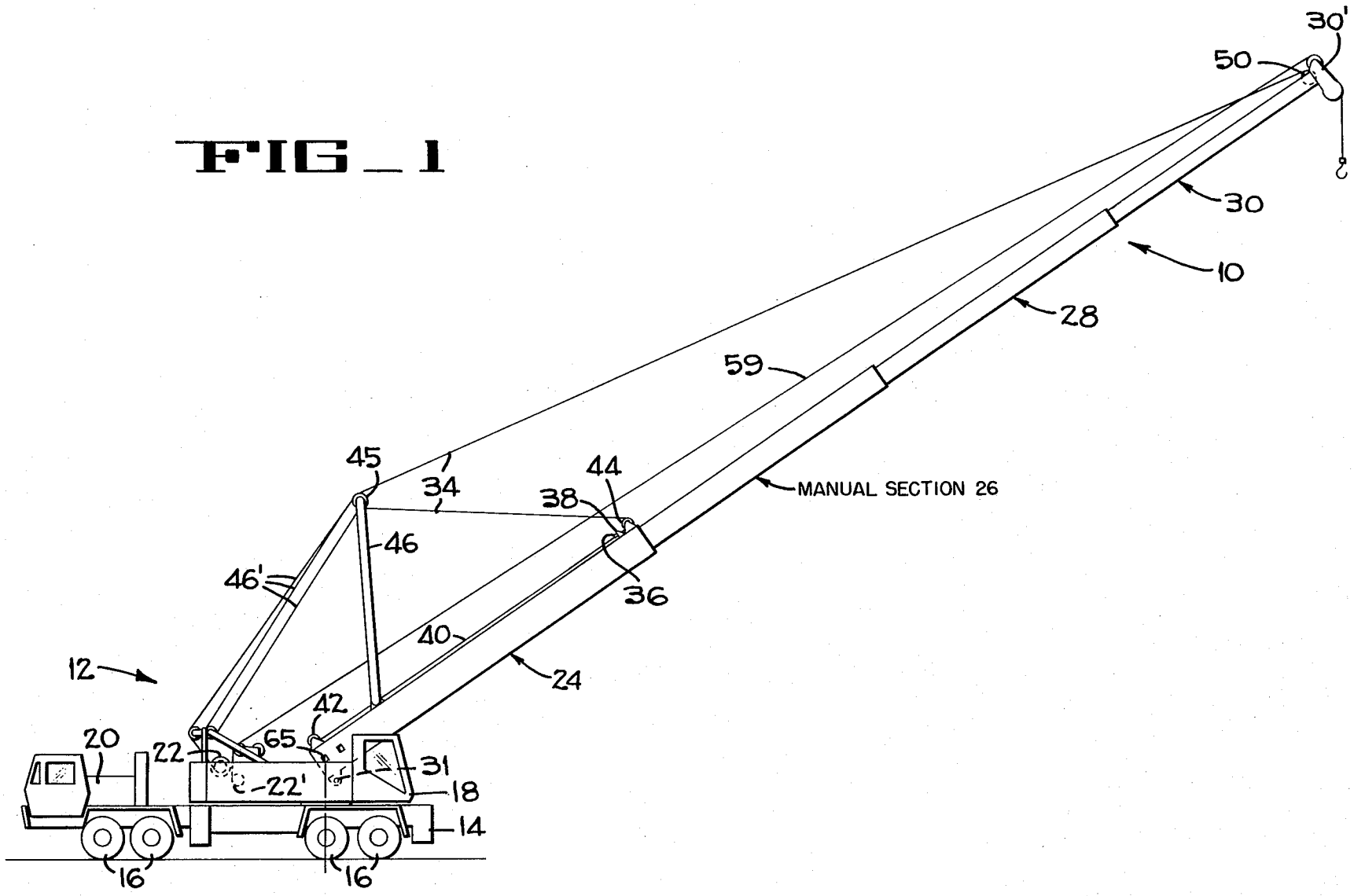
FIG. 1 is a side elevation of a crane with the boom of the present invention supported by pendant lines and illustrated in a fully extended position.

The extensible boom 10 (FIGS. 1 and 2) of the present invention is illustrated as the boom of a mobile crane 12 having a chassis 14 supported on wheels 16, with an upper works 18 mounted for rotation on the chassis about a vertical axis A. The crane includes an engine 20 which provides power for driving at least some of the wheels 16, for rotating the upper works 18, and for driving hydraulic pumps and motors which provide power for several winches, including a boom supporting winch 22 and a load line winch 22' all under the control of an operator and all being conventional in the art.

The boom 10 is illustrated as a four section pendant supported boom which includes an inner base section 24, a manual section 26, a mid section 28, and a tip section 30 all telescopically received within each other and slidably supported on boom shoes (shown only in FIG. 6) of standard design. Boom shoes 25 (FIG. 6) are secured to the outer lower corners of each boom section except the tip section 30; and are secured to the inner upper corners of all boom sections except the base section 24. The boom shoes acts as bearings for minimizing wear during extension and retraction of the boom sections. The base section 24 is the largest boom section in tubular cross section and is the heaviest section, the manual section 26 is the next heaviest section, and the tip section 30 is the smallest in tubular cross section and the lightest section of the boom 10 when the weight of the head machinery 30' is excluded. Each of the four sections of the boom are substantially equal in length.

Figure 2:
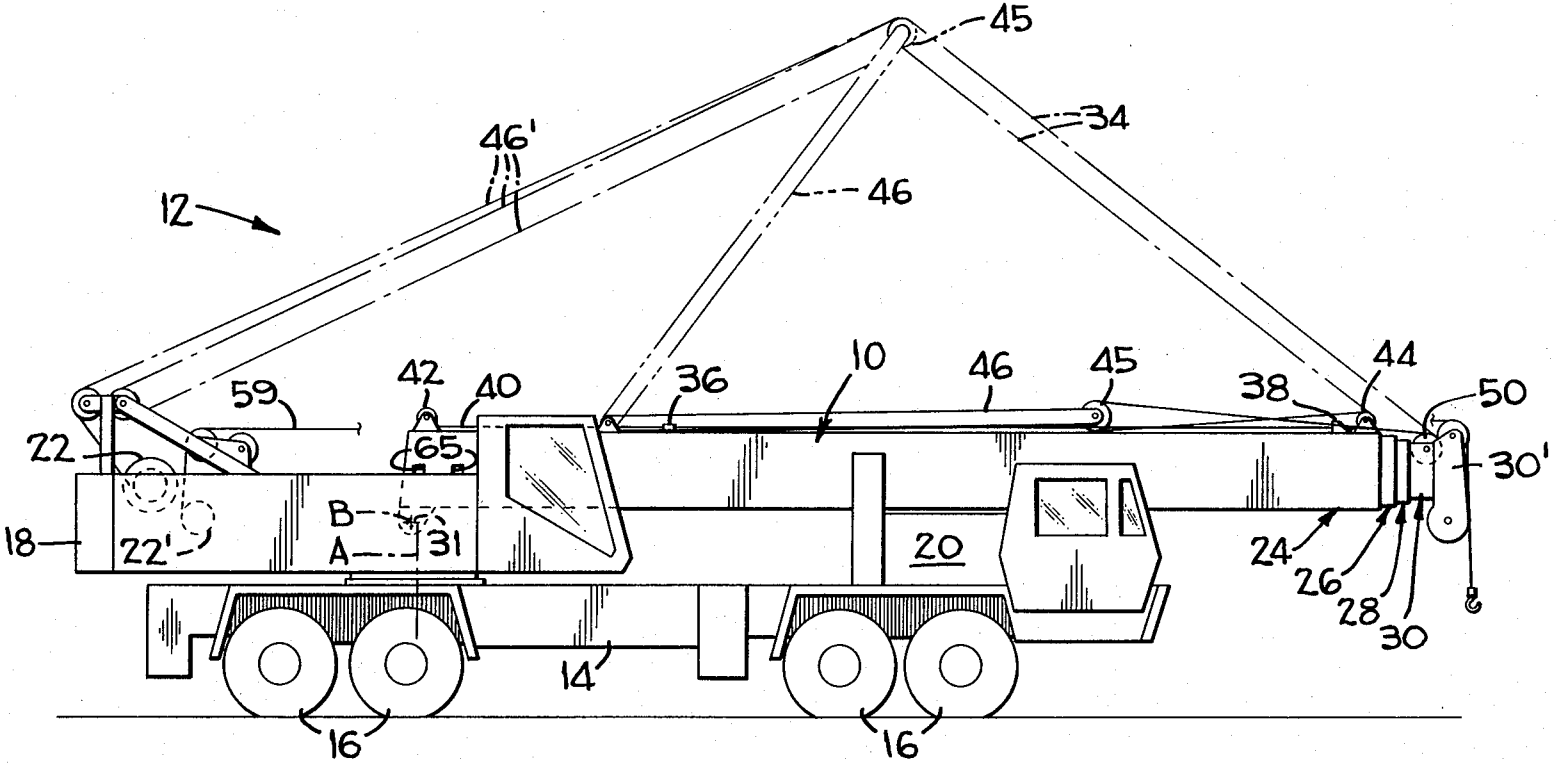
FIG. 2 is an enlarged side elevation of the crane illustrating the boom and live mast in solid lines fully retracted and in transport position; and illustrating, in dotted lines, the live mast and pendants in position to raise the boom.

The base section 24 is mounted on the upper works 18 by a boom foot pin 31 for pivotal movement about a horizontal axis B between a plurality of elevated operative positions, with one elevated position shown in FIG. 1. and a generally horizontal transport position as shown in solid lines in FIG. 2.

The preferred structure for raising and lowering the boom 10 is somewhat similar to that described and claimed in the cross-referenced Cozad application. This structure includes at least one, but preferably two side-by-side fixed pendant lines 34. One end of each pendant line 34 has an abutment 36 (FIG. 2) thereon which engages an abutment 38 (FIGS. 1 and 2) on the base section 24 to anchor the pendant line 34 (FIG. 1) when the boom is being supported by the pendant. When in transport position as shown in FIG. 2, a pendant retract line 40 is wound upon a small winch 42 to maintain tension on the pendant 34 by moving the abutment 36 away from abutment 38. The pendant line 34 is trained around a sheave 44 journaled on the forward end of the base section 24, a sheave 45 journaled on the upper end of a live mast 46, and a sheave 50 journaled on the outer end of the tip section 30 to provide said above mentioned support. The pendant line 34 then enters the boom 10 through the tubular tip section 30 as shown by double lines in FIGS. 3–6. The pendant 34 is then trained around a sheave 51 journaled on the inner end of the tip section 30, is looped around a sheave 52 journaled on the outer end of the cylinder case 53 of the hydraulic ram 54, and is trained around a sheave 56 journaled on the inner end of the manual section 26. The other end of the pendant line 34 is anchored to the outer end of the base section 24 at 57.

As best shown in FIGS. 1 and 2, the boom 10 is raised or lowered by the winch 22 which is connected to the upper end of the live mast 46 by reeving 46'. The load line winch 22' is provided for raising and lowering a load (not shown) that is connected thereto by a load line 59 in a conventional manner.

The inner end of the cylinder case 53 is anchored to the inner end of the mid section 28 while the piston rod 58 of the ram 54 is normally connected to the manual section 26 (FIGS. 3, 4 and 6) but may be connected to the base section 24 (FIG. 5) when it is desired to extend or retract the manual section relative to the base section. The connecting means, as illustrated, includes removable pin 60 which is selectively placed in different holes 58' (FIG. 6) 58" (FIG. 5) within the piston rod 58, the manual section 26, and the base section 24.

More particularly, when it is desired to connect the piston rod 58 to the base section 24, the pin 60 is inserted in the hole 58' in an extension of the piston rod 58 and also in aligned hole 61 (FIGS. 6 and 7) in spaced upright guide plates 62 secured to the inner end of the base section 24. When it is desired to connect the piston rod 58 to the manual section 26, the pin 60 is removed from the base section and rod 58 and is inserted in the rod hole 58" and in aligned holes 63 (FIGS. 5 and 7) in reinforced portions of the side walls of the inner end of the manual section 26.

In order to assure that the piston rod 58 does not rotate about its axis, a guide pin 64 is secured to the piston rod 58 and is received in a chamfered or V-shaped slot 64 in the guide plates 62 thereby assuring proper horizontal alignment of the pin receiving holes.

Figure 3:
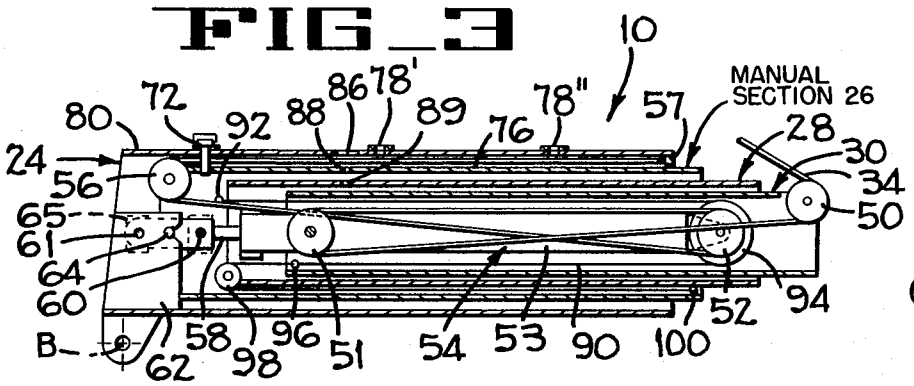
FIG. 3 is a diagrammatic vertical section through all boom sections illustrating the means for extending and retracting the sections with all sections of the boom being fully retracted, the length of each boom section being greatly foreshortened, and the boom shoes or bearings being omitted for clarity.

Access openings 65 (FIGS. 1, 2, 5 and 6) are provided in the side walls of the base section 24 to permit easy removal of the pin 60 when the boom 10 is fully retracted and the attachment of the piston rod 58 is to be shifted between the illustrated position in FIG. 3 and a position attached to the holes 61 in the base section guide plates 62.

Figure 7:
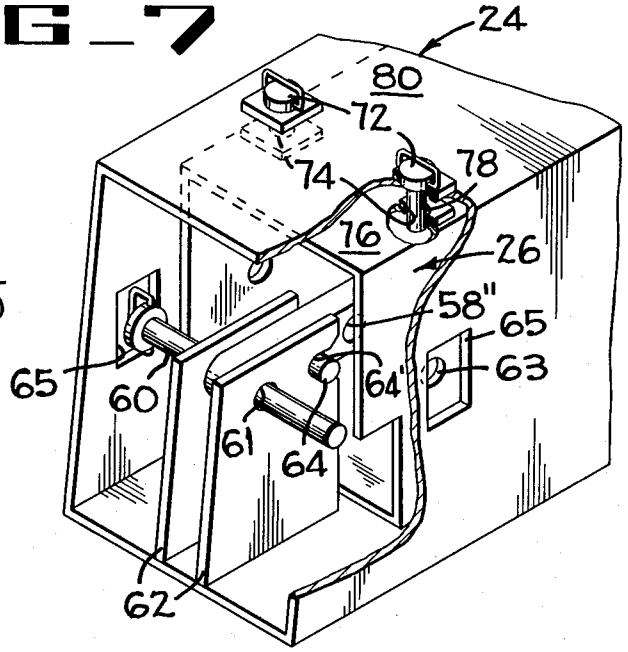
FIG. 7 is a perspective of a fragment of the upper portions of the manual and base sections illustrating a pair of manual-base lock pins, certain parts being cut away and other parts shown in section.
Figure 4:
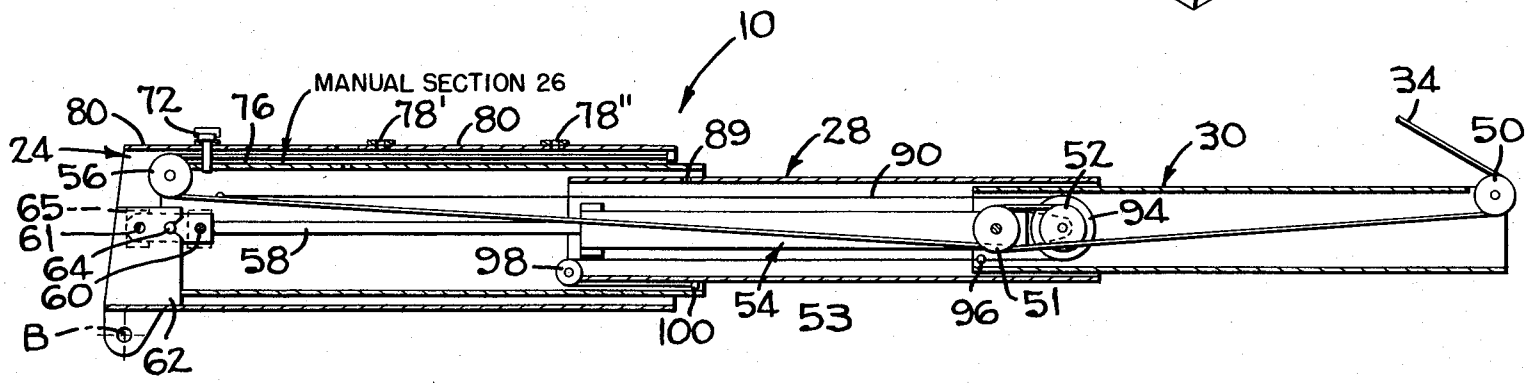
FIG. 4 is a diagrammatic section similar to FIG. 3 with the manual section retracted and stored in the base section, but with the mid section and tip section fully extended.

Having reference to FIGS. 3–7, locking means in the form of a removable locking pin 72 (FIG. 7) is selectively inserted in reinforced holes 74 in the top wall 76 of the manual section 26. The holes are aligned with the reinforced holes 78 in the top wall 80 of the base section 24 to lock the manual 26 in stowed position within the base section 24 as illustrated in FIGS. 3, 4 and 7. Similarly when it is necessary to partially or fully extend all four boom sections to reach the load to be handled, the locking pins 72 are removed from the holes 74, 78, the manual is extended, and the pins 72 are inserted in holes 78',74 (FIG. 6) or 78",74 depending upon whether partial or full extension of the manual section is required.

Prior to extending the three outer sections relative to the base section, it is necessary to lock the manual section 26 to the mid section 28. For this purpose second locking means in the form of at least one manual - mid lock pin 84 (FIG. 5) is inserted through an access opening 86 in the base section 24 and into locking engagement in aligned holes 88,89 in the manual and mid sections, respectively.

As shown in FIGS. 3–6, the tip section 30 is extended and retracted in response to extension and retraction of the ram 54 when the piston rod 58 is connected to the manual section 26 and the manual-mid lock pin 84 is removed. For this purpose at least one extend-retract cable 90 is provided and is illustrated in FIGS. 3–6 in single lines to distinguish it from the pendant line 34 which is illustrated in double lines.

One end of the extend-retract cable 90 is attached to the inner end of the manual section 26 by a connector 92, such as a bolt. The cable then extends around a sheave 94 journaled on the outer end of the ram 54, an intermediate portion of the cable 90 is attached to the inner end of the tip section 30 by another connector 96, and the cable is then trained around a sheave 98 journaled on the inner end of section 28, and the other end of the cable 90 is attached to the outer end of the manual section 26 by a connector 100.

Figure 5:
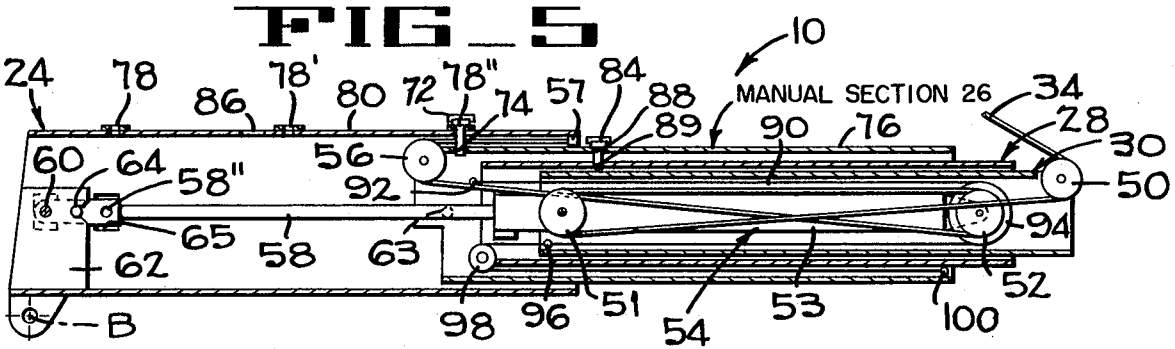
FIG. 5 is a diagrammatic section similar to FIG. 3 but with the manual section extended and with the mid and base sections retracted within the manual section.
Figure 6:
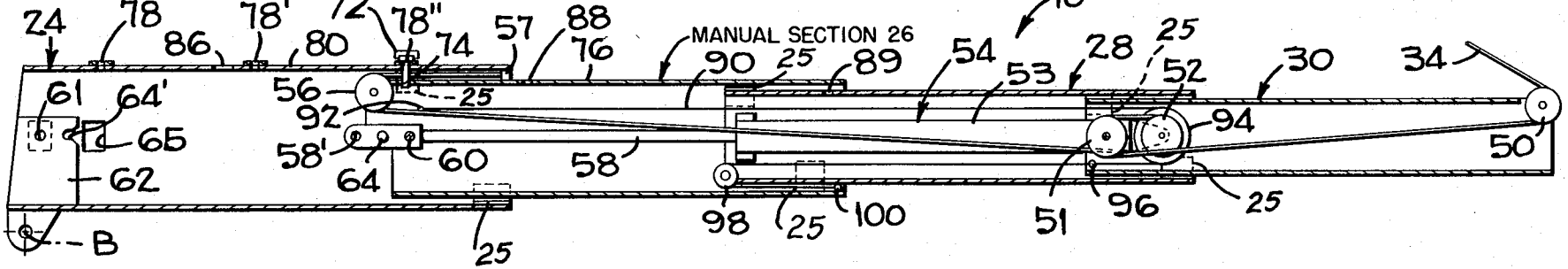
FIG. 6 is a diagrammatic vertical section similar to FIG. 3 but with the manual section locked in extended position and with the mid and tip sections fully extended.

Thus, when the piston rod 58 is connected to the manual section 26, full extension of the ram 54 will fully extend both the mid section 28 and the tip section 30 relative to the manual section 26 and the base section 24 as shown in FIGS. 4 and 6. When the piston rod 58 is connected to the manual section, full retraction of the ram will fully retract the mid and tip sections within the manual section as shown in FIGS. 3 and 5. Partial extension or retraction of the ram 54 will partially extend or retract the mid and tip sections proportionally relative to the manual section 26.

In operation of the boom of the present invention, the boom 10 (FIGS. 1 and 2) is elevated and supported in elevated position by the pendant lines 34, winch 22 and reeving 46' in a manner similar to that disclosed and claimed in the previously referred to Cozad application filed on even date herewith. It will be understood, however, that extension or retraction of the manual section is performed when the boom 10 is in a generally horizontal position.

When a load is connected to the load line 59 and is to be transferred between two positions by the crane 10, and when such work can be done with only two sections extended relative to the base section 24 as is the usual situation; the manual section 26 is retracted and stowed in the base section 24 as illustrated in FIGS. 3 and 4. When the manual section 26, which is the second heaviest boom section, is stored in the base 24 adjacent the pivot axis B defined by the boom foot 31, it will be appreciated that the turning moment about axis B, due to the weight of the boom sections, will be considerably less than that of the prior art boom having sections of exactly the same size and weight but with the inner three sections extended and the tip section retracted. Stated in another way, the turning moment acting on the boom due to the weight of the boom sections is equal to the weight of the boom sections at their centers of gravity multiplied by the distance of the centers of gravity of the boom sections from the pivot axis B. Since in accordance with the present invention the center of gravity of the heavy manual section 26 is substantially closer to the axis B than in said prior art devices having the manual as the outer boom section, the moment due to boom section weight is considerably less in the subject boom than in said prior art booms when operating with all but one section extended.

The use of a single hydraulic ram 54 with its center of gravity closer to the pivot axis B than in prior art booms, in accordance with the preferred embodiment of the invention, additionally reduces the moment of the boom due to boom weight.

Since the boom moment is reduced as above described when being used with all but the manual section 26 extended; the boom, when operated by a single ram and when supported by pendants, is capable of carrying about 15 percent heavier loads than a comparable boom with the manual section being the outer or tip section.

In order to operate the boom with all four boom sections fully extended, all sections are first fully retracted to the position illustrated in FIG. 3. The pin 60 is then removed from the holes in the manual section 26 and piston rod 58 and is pulled out of the access opening 65 (FIG. 5) in the base section 24. The pin 60 is then positioned in the holes 58',61 to couple the piston rod 58 to the base section 24. The manual to mid lock pin 84 (FIG. 5) is then inserted in the hole 88,89 locking the manual section 26 and mid section 28 together. The lock pins 72 (FIG. 5) are then removed and the ram 54 is actuated to extend the piston rod 58 and manual section 26 to an intermediate or fully extended position with the hole 78' or 78" aligned with holes 74, respectively, to lock the manual to the base 24 in the intermediate position or the fully extended position of FIG. 5 upon inserting the pins 72 into the selected holes.

The manual to mid lock pin 84 is then removed from holes 88,89; the pin 60 is then removed from the holes in the piston rod 58 and base section 24; the piston rod 58 is then retracted; and the piston rod is then coupled to the manual section 26 by pin 60 extending through holes 58" and 63. Selective operation of the hydraulic ram 54 then extends and retracts the mid section 28 and the tip section 30 relative to the manual section 26 and base section 24 as described above but with the manual section locked in a selected one of a plurality of extended positions to reach articles beyond the range of the boom when the manual is retracted.

From the foregoing description it will be apparent that the boom of the present invention includes a heavy manual section that is locked within the base section close to the boom pivot point when not in use thereby reducing the turning moment of the boom about its pivot axis due to boom weight and consequently increases the load carrying capacity of the boom.

Although the best mode contemplated for carrying out the present invention has been herein shown and described, it will be apparent that modification and variation may be made without departing from what is regarded to be the subject matter of the invention.

What is claimed is:

1. An extensible telescopic boom for a crane or the like comprising means defining a tubular base section; means supporting said base section for pivotal movement about a horizontal axis; means defining a manual section telescopically received in said base section; means defining at least one additional boom section telescopically received in said manual section; power means having a single cylinder case anchored to and movable with said additional section and having a piston rod; coupling means for selectively coupling said piston rod of said cylinder to said base section for selectively extending or retracting said manual section relative to said base section, or for coupling said piston rod to said manual section when disconnected from said base section for extending and retracting said at least one additional section relative to said manual section; means for locking said manual section in one of a plurality of selected positions; said at least one additional section including said additional section and a tip section telescopically received in said additional section; and extend-retract connecting means continuously and operatively connecting said manual section, said additional section, and said tip section to said single cylinder case and responsive to extension of said single cylinder and said additional section for proportionally extending said tip section and said additional section relative to said manual section.

2. An apparatus according to claim 1 wherein said connecting means comprises a first sheave journaled on the outer end of said cylinder; a second sheave journaled on the inner end of said additional section; and an extend-retract cable anchored to the inner end of said manual section, is trained around said sheaves, and is anchored to both the inner end of said tip section and to the outer end of said manual section.

3. A multi-section extensible telescopic boom having improved load carrying capacity, said boom comprising a base section; means mounting said base section on a support structure for pivotal movement about a horizontal axis, and support means for pivotally raising and lowering said boom; the improvement which comprises a manual section telescopically received within said base section; a mid section telescopically received within and being lighter than said manual section; an outer tip section telescopically received within and being lighter than said mid section and adapted to support a load; power means having a single cylinder case anchored to and movable as a unit with said mid section and having a piston rod; and means for selectively coupling said piston rod either to said base section for moving said manual section between a retracted stowed position within said base section and an extended position projecting a substantial distance outwardly of said base section, or to said manual section for simultaneously extending or simultaneously retracting said mid and tip sections relative to each other and to said manual section, means for locking said manual section in the selected position; said power means also including a first sheave journaled on said cylinder and a second sheave journaled on said mid section; and a flexible extend-retract cable trained over said sheaves and connected to the inner end portions of the manual and tip sections and to the outer end portion of the manual section for proportionally extending or retracting the tip section and said mid section relative to the manual section.

4. An apparatus according to claim 3 wherein said support means includes a mast connected to and extending upwardly from said boom; external sheaves journaled on the outer ends of said base section, said mast, and said tip section; internal sheaves journaled on the inner portion of said tip section, said manual section, and on the outer end of said cylinder; a pendant line trained around said external and internal sheaves and having one end anchored to the outer end of said base section and the other end held from movement externally of said base section when the pendant line is supporting said boom, and second power means connected between said mast and to the support structure for changing the elevation of said boom.

* * * * *